US008172281B2

(12) United States Patent
Crorey

(10) Patent No.: US 8,172,281 B2
(45) **Date of Patent: *May 8, 2012**

(54) DEVICE AND KIT FOR MAKING KNOTTED STRING ACCESSORIES

(76) Inventor: David J. Crorey, Clinton Township, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/083,689

(22) Filed: Apr. 11, 2011

(65) Prior Publication Data

US 2011/0181043 A1 Jul. 28, 2011

Related U.S. Application Data

(63) Continuation of application No. 12/395,857, filed on Mar. 2, 2009, now Pat. No. 7,946,631.

(51) Int. Cl.
*D03J 3/00* (2006.01)

(52) U.S. Cl. ..... 289/17

(58) Field of Classification Search ..... 289/13, 289/15, 16.5, 17, 18.1
See application file for complete search history.

(56) References Cited

U.S. PATENT DOCUMENTS

| | | | | |
|---|---|---|---|---|
| 2,123,077 | A * | 7/1938 | Mayer | 28/151 |
| 2,129,297 | A * | 9/1938 | Zippel | 28/151 |
| 2,395,981 | A * | 3/1946 | Walker | 289/17 |
| 6,119,854 | A * | 9/2000 | Prentice et al. | 206/209.1 |
| 7,946,631 | B2 * | 5/2011 | Crorey | 289/2 |
| 2006/0169608 | A1 * | 8/2006 | Carnevali | 206/320 |

* cited by examiner

*Primary Examiner* — Shaun R Hurley
(74) *Attorney, Agent, or Firm* — Young Basile

(57) ABSTRACT

Disclosed herein are embodiments of devices and kits for making knotted string accessories. One embodiment of a device for making knotted string accessories from a plurality of individual strings comprises a substantially planar member with a first end and a second end opposite the first end; a securing member carried by the substantially planar member proximate to the first end and configured to secure a first end of the plurality of individual strings; and an elongated holder carried by the substantially planar member proximate the second end, the elongated holder comprising a plurality of individual holders each configured to retain at least one of the plurality of individual strings at a location a spaced distance from the first end, wherein the securing member and elongate holder are configured such that a distance between the securing member and the elongated holder is changeable.

20 Claims, 9 Drawing Sheets

SECTION A-A

SECTION B-B

DEVICE AND KIT FOR MAKING KNOTTED STRING ACCESSORIES

CROSS REFERENCE TO RELATED APPLICATIONS

This application is a continuation of U.S. patent application Ser. No. 12/395,857 filed on Mar. 2, 2009 and issued as U.S. Pat. No. 7,946,631 B2 on May 24, 2011, incorporated herein by reference in its entirety.

FIELD OF THE INVENTION

The present invention relates in general to hand crafted accessories and more particularly to devices to assist the making of knotted string jewelry and accessories and kits for making the same.

BACKGROUND

A popular craft project involves making accessories such as bracelets and necklaces by knotting colorful string. The practice involves many strands of string knotted in a particular pattern to produce the desired product. The process is made easier by keeping the strings separated and somewhat stationary to keep track of the pattern as the product is made. This requires dexterity and can require an uninterrupted time and place in which to craft. Knotted string bracelets have become very popular with adolescents and teens to wear and give to friends. The craft is often done with others, with any minor distraction making it difficult to keep track of the pattern and maintain the strings in the correct positions. In an effort to better manage the strings while crafting, it has been known to use tape to secure the string to a table or the like. A device for maintaining the string stationary and providing a simple management system would simplify the craft and make it more enjoyable, particularly for the younger crafters.

BRIEF SUMMARY

Disclosed herein are embodiments of devices for making knotted string accessories from a plurality of individual strings. One embodiment of a device for making knotted string accessories from a plurality of individual strings comprises a substantially planar member with a first end and a second end opposite the first end; a securing member carried by the substantially planar member proximate to the first end and configured to secure a first end of the plurality of individual strings; and an elongated holder carried by the substantially planar member proximate the second end, the elongated holder comprising a plurality of individual holders each configured to retain at least one of the plurality of individual strings at a location a spaced distance from the first end, wherein the securing member and elongate holder are configured such that a distance between the securing member and the elongated holder is changeable.

Another embodiment of a device for making knotted string accessories comprises a substantially planar member with a first end and a second end opposite the first end; a securing member carried by the substantially planar member proximate to the first end and configured to secure a first end of each of the plurality of individual strings; and an elongated holder carried by the substantially planar member proximate the second end, the elongated holder comprising a plurality of individual holders each configured to retain at least one of the plurality of individual strings at a location a spaced distance from the first end, wherein the securing member is positioned to secure the first end of the plurality of individual strings substantially center between outermost individual holders.

Other embodiments are described in more detail in the detailed description herein.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
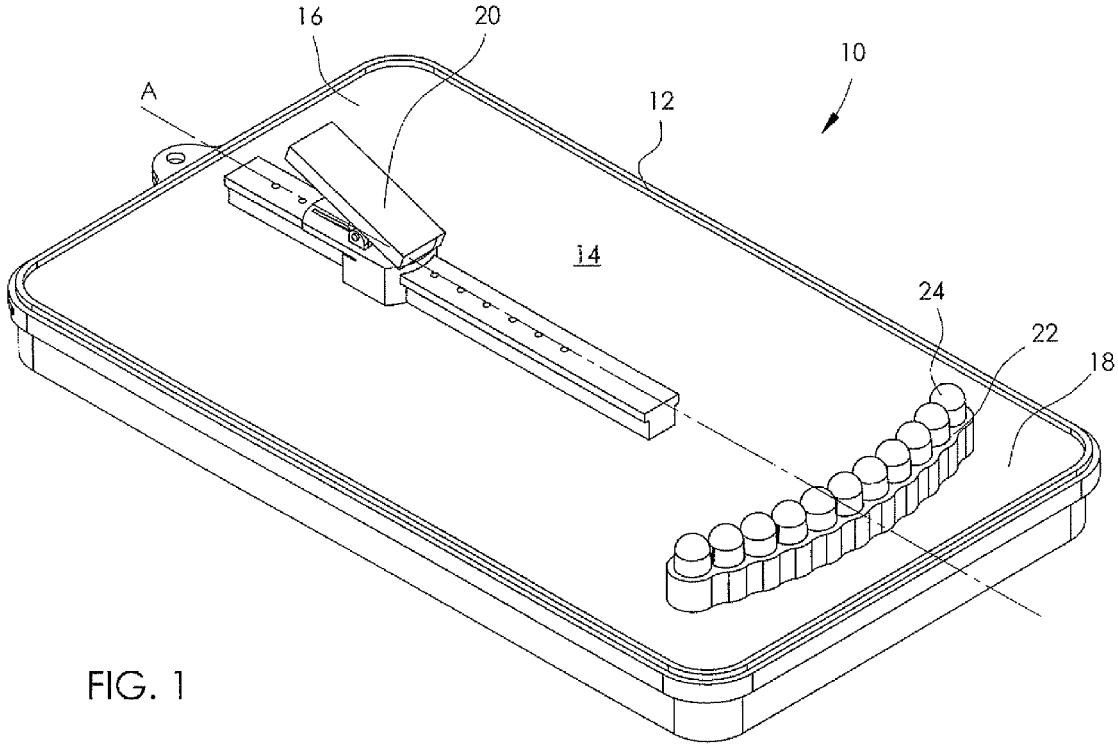
FIG. 1 is a perspective view of an embodiment of a device for making knotted string accessories as disclosed herein.

FIG. 1 is a perspective view of an embodiment of a device for making knotted string accessories. The device 10 for making knotted string accessories from a plurality of individual strings comprises a base 12, which is a substantially planar member with a substantially planar surface 14 with a first end 16, a second end 18 opposite the first end 16, and a longitudinal axis A. A securing member 20 is connected to the substantially planar surface 14 proximate to the first end 16. An elongated holder 22 is connected to the substantially planar surface 14 proximate the second end 18 and can be substantially perpendicular to the longitudinal axis A. The elongated holder 22 comprises a plurality of raised portions 24 positioned along the elongated holder 22 and extending outward from the substantially planar surface 14 in close proximity to one another. Adjacent raised portions 24 are configured to retain individual pieces of string.

As used herein, "substantially planar surface" means having a two-dimensional characteristic able to position the securing member and the elongated holder as required for making the string accessories. The term does not limit the surface to being smooth, as the surface may be textured if desired or required. As used herein, "substantially perpendicular" means that at some position on the elongated holder, the angle between that position and the longitudinal axis A is roughly ninety degrees. This is because the elongated holder is not required to be linear.

The longitudinal axis A is an axis of the device running from the first end to the second end and vice versa. Although shown down the approximate center of the device, the bisection of the device is not critical and is not meant to be limiting. The axis is for directional purposes only.

Figure 2:
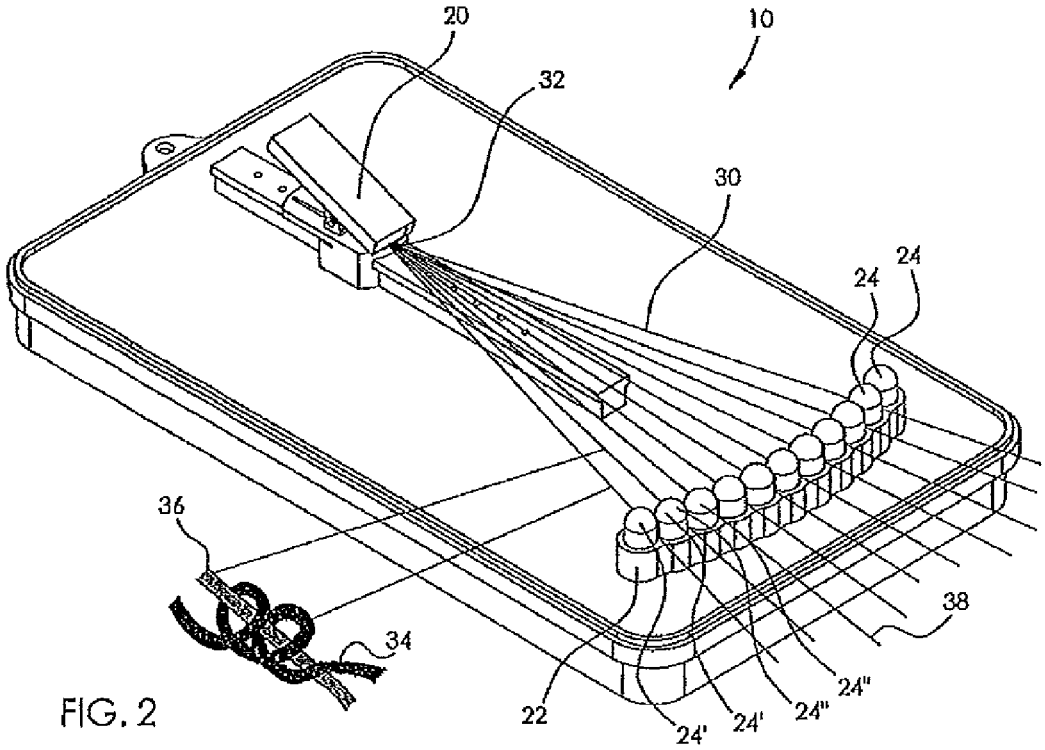
FIG. 2 is the perspective view of FIG. 1 showing the initial placement of a plurality of strings in the embodiment of the device disclosed herein.

A plurality of individual strings is used with the device to make the knotted string accessories. FIG. 2 is the perspective view of FIG. 1 showing the initial placement of the plurality of strings 30 in the device 10. In use, a first end 32 of the plurality of strings is gathered and secured with the securing member 20. The first end 32 of the plurality of strings can be knotted together before securing in the securing member 20. Each individual string of the plurality of strings 30 is retained with the elongated holder 22 such that they are substantially taught between the securing member 20 and the elongated holder 22. The strings can be held between adjacent raised portions 24 of the elongated holder 22 such that the strings are sufficiently taut. As shown in FIG. 2, ten individual strings are used. This is provided by way of example and is not meant to be limiting. Any number of strings can be used as desired or required based on individual preference or the requirements of a pattern.

To make the knotted string accessory, the typical method is to remove the two strings on the left from the elongated holder 22, shown in FIG. 2 as 34 and 36, and knotting them as shown in the exploded view, with the leftmost string 34 knotted around the string 36. Two loops are shown in FIG. 2 as an example and are not meant to be limiting. Other numbers of loops and other directions of knotting can be performed as desired or required by the individual or the pattern. The knot is then moved toward the first end 32 of the plurality of strings 30. The leftmost string 34 remains free while the string 36 is placed between the leftmost adjacent raised portions 24'. The string 38 to the right of string 36 is removed and the leftmost string 34 is knotted about that string 38. String 38 is moved one position to the left and retained between the adjacent raised portions 24". This continues until the leftmost string 34 has knotted each of the other individual strings and is finally retained between the two rightmost raised portions. The process is repeated until the accessory is complete. The distance between the securing member 20 and elongated holder 22 changes to accommodate the string as its length decreases.

The term "knotted" as used herein means any interaction between at least two individual strings that contributes to the pattern of the accessory being made. Other common terms are weaving, tying, braiding, and the like. The method described above is provided by way of example and is not meant to be limiting. The movement of the strings and order in which they are taken up may be different depending on the pattern being made.

The securing mechanism 20 can be a clip, described in more detail below. The securing mechanism 20 can be a hook, a clasp, a pin, or other means of securing the first end of the string. The securing mechanism 20 can also be any raised member configured to receive and maintain a loop.

Figure 3:
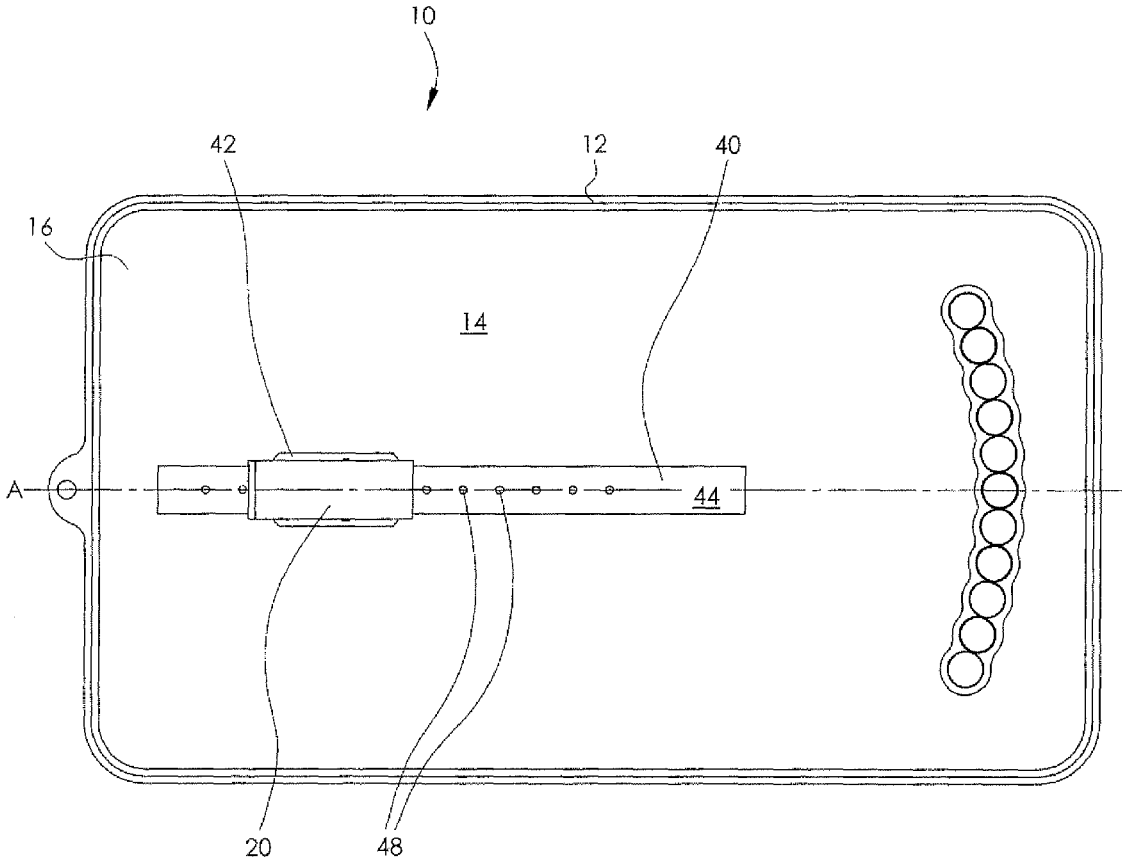
FIG. 3 is a top plan view of an embodiment of the device for making knotted string accessories as disclosed herein.

Embodiments of the device 10 can further comprise a rail member 40, as shown in FIG. 3, a top plan view of the device of FIG. 1, although not necessary. The rail member 40 can be carried on the substantially planar surface 14 proximate the first end 16 of the base 12. The rail member 40 can be positioned substantially parallel to the longitudinal axis A. The securing member 20 can be movably attached to the rail member 40 and positionable at a plurality of discrete locations defined along the rail member 40. The securing member 20 can be slidably movable along the rail member 40. This can best be seen in FIG. 4, a side view of the device 10. The rail member 40 is illustrated having a top surface 44 raised from the substantially planar surface 14 of the base 12 and having two sides 46 extending from the top surface 44 to the planar surface 14. The guide member 42 attached to the securing member 20 movably engages one or more of the top surface 44 and sides 46 to slide along the rail member 42.

Other means of movably attaching the securing member 20 to the rail member 40 are contemplated. For example, the rail member 40 may have one or more tracks therein, and the securing member 20 may have one or more cooperating guides to ride in the track(s). The rail member 40 may have apertures along the top surface with the securing member 20 having cooperating pegs to fit into the apertures. It is further contemplated that the securing member 20 be directly attached to the substantially planar surface 14 of the base 12 and either movable such as along a track or permanently affixed.

Figure 4:
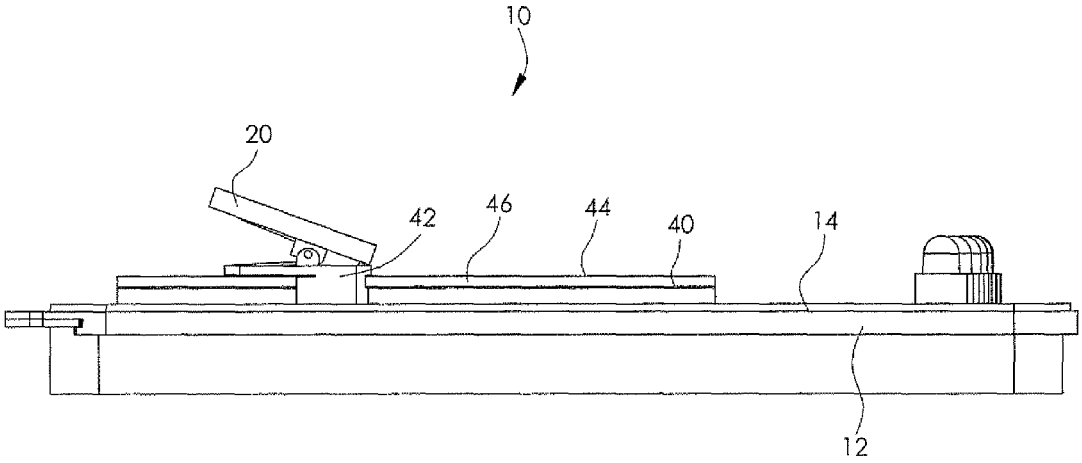
FIG. 4 is a side view of an embodiment of the device for making knotted string accessories as disclosed herein.

The rail member 40 can have a plurality of spaced-apart indentations 48 along the top surface 44, best seen in FIG. 3. The securing member 20 can have a detent (not shown) positioned for engagement with at least one of the plurality of indentations 48 to position the securing member 20 at the plurality of discrete locations along the rail member 40. Alternatively, as represented in FIG. 4, the guide member 42 can have the detent (not shown) positioned for engagement with at least one of the plurality of indentations 48 to position the securing member 20 at the plurality of discrete locations along the rail member 40. The detent is provided by way of example and is not meant to be limiting. Other mechanisms configured to engage at least one of the securing member 20 and guide member 42 are contemplated, such as a thumb screw, peg, etc.

The rail member 40 as illustrated in the Figures is provided by way of example and is not meant to be limiting. The rail member 40 can have a rounded top surface and sides. The rail member 40 can be integral with the substantially planar surface 14. The rail member 40 can be any width sufficient to accommodate the securing mechanism and/or the indentations. Other dimensions of the rail member 40 can be varied as desired or required by those skilled in the art while maintaining its functionality.

The plurality of discrete locations to which the securing member 20 can be moved functions to maintain some tautness to the strings as completion of the accessory progresses. For example, as the length of the unknotted string decreases, the securing member 20 can be moved toward the elongated holder 22 so that the shorter string can be retained between the raised portions 24.

Figure 5:
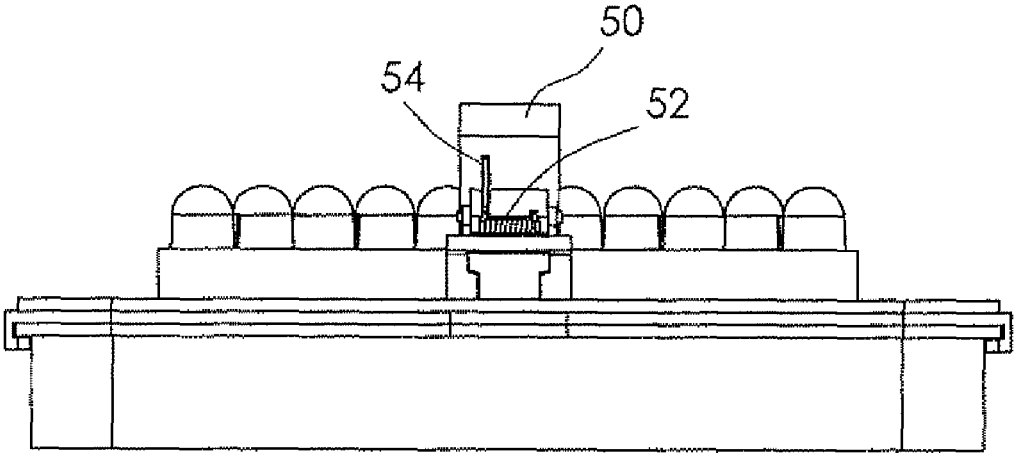
FIG. 5 is a first end view of an embodiment of the device for making knotted string accessories as disclosed herein.

The securing member 20 can be a clip such as that shown in FIG. 4. As shown in FIG. 5, a first end view of the device 10, the clip 50 can have a spring 52 configured to bias the clip 50 to secure the first end of the plurality of individual strings. When force is placed on the spring 52, the clip will open to receive the string. With the force removed, the spring returns the clip to the closed position, securely retaining the string. The clip 50 can be any shape as desired or required. For example, the clip 50 could be in the shape of a butterfly, flower, peace sign, animal, star, etc. in an effort to make the device more aesthetically pleasing. The securing member 20 is generally positioned such that its securing portion is substantially center along the elongated holder 22, as shown in the figures.

Where a guide member 42 is used and the detent is located on the guide member 42, the spring 52 with tines 54, 56 can be positioned between the clip 50 and the guide member 42. This positioning can be such that the tine 56 opposite the tine 54 biasing the clip 50 puts pressure on the guide member 42 to maintain the detent in an indentation 48. The pressure from the tine 56 can be sufficient to maintain the position of the securing member 20 during use of the device 10 while also low enough to be overcome by a user adjusting the positioning of the securing member 20 to another indentation 48. This configuration can best be seen in FIG. 6, an expanded view of this embodiment of the device 10. In this embodiment, the spring 52 is shown connectible to the clip 50 and guide member 42 with a pin 58. This is shown by way of example and is not meant to be limiting. Other attachment means can be used to connect the spring to the clip and guide member.

Figure 6:
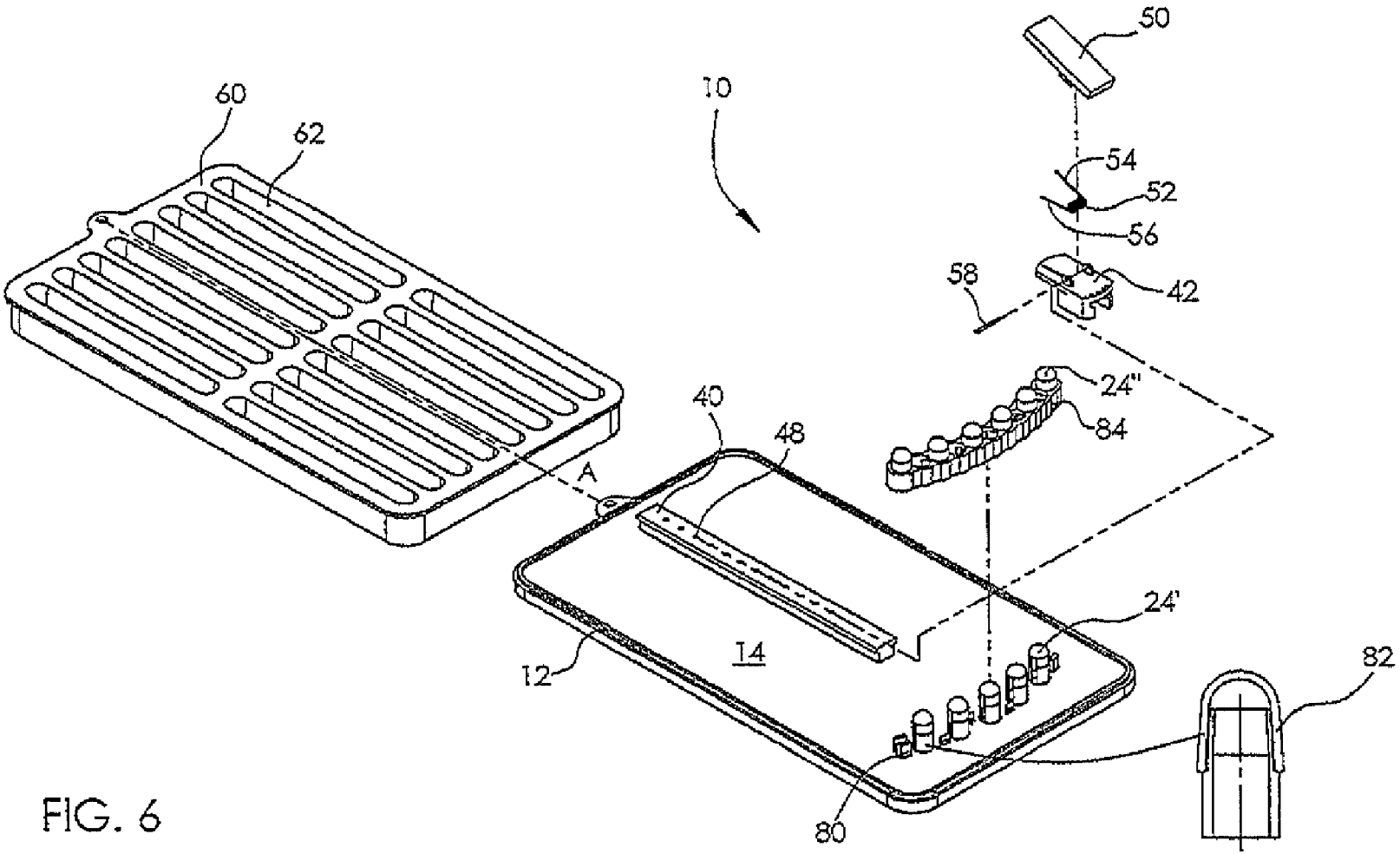
FIG. 6 is an expanded view of an embodiment of the device for making knotted string accessories as disclosed herein.

Embodiments of the device 10 for making knotted string accessories can also comprise a storage compartment 60, shown in FIG. 6. The storage compartment 60 can have at least one inner cavity 62. In FIG. 6, the embodiment is shown with many inner cavities 62 by way of example. The inner cavities can be any shape desired or required. The storage compartment 60 can store anything that is sized to be retained in the inner cavities 62. However, it is contemplated that different strings, beads, gems, instructions, patterns etc will be stored in the inner cavities 62.

Figure 7:
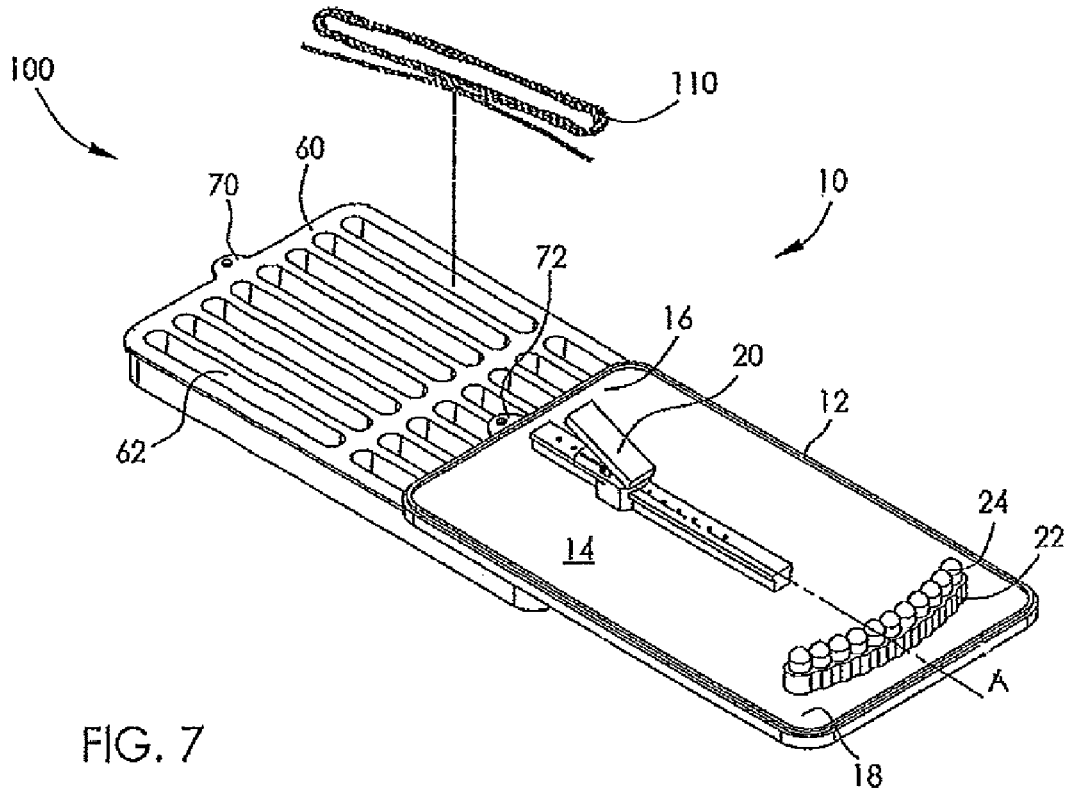
FIG. 7 is a perspective view of an embodiment of a device for making knotted string accessories with a storage compartment as disclosed herein.
Figure 8:
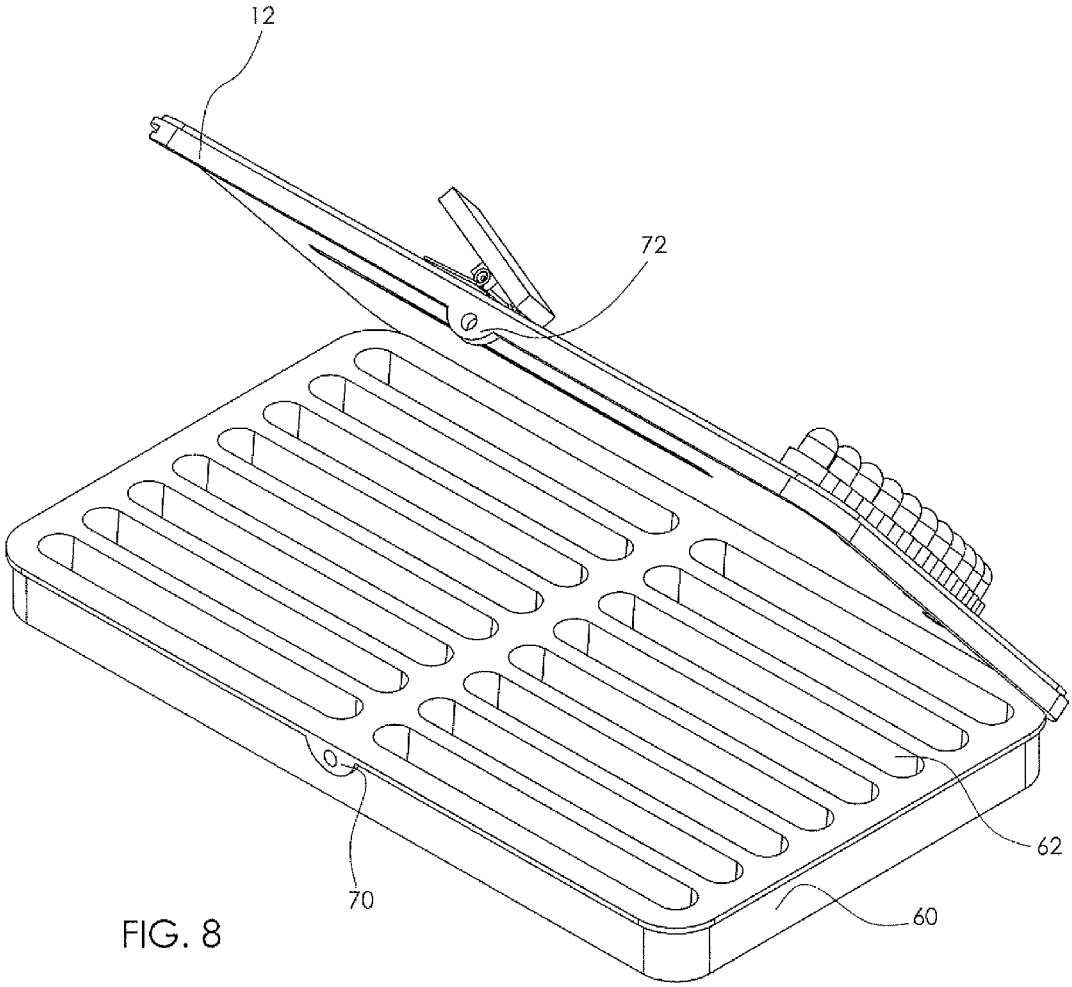
FIG. 8 is a perspective view of another embodiment of a device for making knotted string accessories with a storage compartment as disclosed herein.

The storage compartment 60 can releasably engage the base 12. For example, the base 12 can be slidably attached to the storage compartment 60 so that it is moveable between an open position and a closed position. FIG. 7 is a perspective view of the base 12 slidably attached to the storage compartment 60, with the base 12 in a partially open position. One or more of the inner cavities can be exposed when the base 12 is in an open or partially open position, allowing communication with the exposed inner cavities to retrieve or store items. FIG. 8 is another example of a storage compartment 60 releasably engaged with the base 12. In this alternative, the base 12 is pivotally attached to at least one side of the storage compartment 60 and is movable between an open position and a closed position. The base 12 can be pivotally attached to any one of the sides of the storage compartment and can be attached, for example, by one or more hinges and the like.

The Figures herein illustrate the base 12 and the storage compartment 60 as being rectangular in shape. This shape is provided by way of example and is not meant to be limiting. The base and storage compartment can be other shapes, for example, square, triangular, hexagonal, etc. The base can have a larger surface area than the storage compartment. The storage compartment can be as deep as desired or required.

Embodiments of the device 10 disclosed herein can further have a latching mechanism configured to secure the base 12 to the storage compartment 60 in the closed position. Both FIGS. 7 and 8 illustrate the latching mechanism as having a latch member 70 on the storage compartment 60 and a latch member 72 on the base 12 that cooperate with one another so that when in the closed position, the apertures in the latch members 70, 72 align to receive, for example, a pin, a lock, a tie or a similar mechanism to maintain the latch members 70, 72 together. The latch mechanism shown in FIGS. 7 and 8 is provided by way of example and is not meant to be limiting. Other means can be used to maintain the base and storage compartment in the closed position as desired or required.

As discussed above, embodiments of the device 10 disclosed herein comprise an elongated holder 22. The elongated holder 22 can have a plurality of raised portions 24 along the holder 22. The plurality of raised portions 24 can include a retainer mechanism between adjacent raised portions 24 configured to retain the individual strings, as shown in FIG. 2. The retaining mechanism can be as simple as the compressive force between the adjacent raised portions 24, particularly if elastic material such as foam is used for the raised portions. The retaining mechanism can be, for example, slits made in the elongated holder 22 between the adjacent raised portions 24. The individual string can be placed in the slit and tightly gripped by the surrounding raised portion. Pieces of elastic material can be placed between the adjacent raised portions to elastically compress the string. Adjacent raised portions can be coated with an elastic material like rubber to hold the strings there between.

Referring back to FIG. 6, an embodiment of an elongated holder is shown in an expanded view. In this embodiment, the elongated holder is manufactured in two pieces. A first piece 80 is shown integral with the planar surface 14 of the base 12. However, it can be a separate piece attached to the planar surface 14 if desired. The first piece 80 provides every other raised portion 24' of the elongated holder. Side springs 82 are integrally formed in each of these raised portions 24' on opposing sides. The second piece 84, providing the alternate raised portions 24" from the first piece 80, is configured to fit over the top of the first piece 80. The second piece 84 has apertures between the raised portions 24" through which the raised portions 24' of the first piece 80 extend. Once extended, the side springs 82 expand toward the raised portions 24" of the second piece 84, thereby creating the retainer mechanism 86 between adjacent raised portions 24', 24" that is configured to retain the individual string.

Figure 9B:
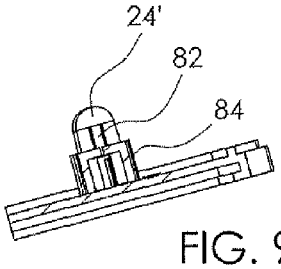
FIG. 9B is a cross sectional view of the elongated holder of FIG. 9A along line A.
Figure 9A:
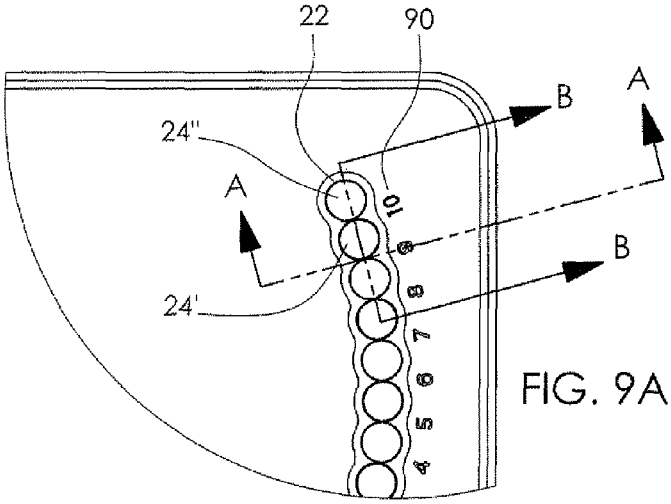
FIG. 9A is an exploded view of an embodiment of an elongated holder of a device for making knotted string accessories as disclosed herein.
Figure 9C:
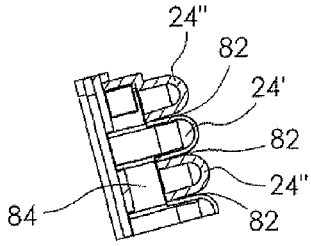
FIG. 9C is a cross sectional view of the elongated holder of FIG. 9A along line B.

FIGS. 9A-C are exploded views of the elongated holder described above. FIG. 9B is a cross section of the elongated holder 22 along line A of FIG. 9A. From this view, a raised portion 24' is shown extending through an aperture in the second piece 84 of the elongated holder 22. FIG. 9C is a cross section of the elongated holder 22 along line B of FIG. 9A. FIG. 9C shows alternating raised portions 24" and 24'. The side springs 82 in the raised portions 24' are shown.

Embodiments of the device 10 disclosed herein can have indicia 90 on the substantially planar surface 14 of the base 12. The indicia 90 can be located proximate the plurality of raised portions to sequence the raised portions. As shown in FIG. 9, the indicia comprise numbers in series and equal to the number of raised portions 24, however letters can also be used. The indicia can be used to assist in the making of the accessory or assist in instructing a user how to use the device. Other indicia are contemplated as desired or required.

Also disclosed herein are embodiments of kits for making knotted string accessories. One embodiment disclosed herein of a kit for making knotted string accessories comprises a device for making knotted string accessories. Embodiments of this device are described in detail above and are incorporated herein. Referring to FIG. 7 by way of illustration, the device 10 of the kit 100 can comprise a base 12 having a substantially planar surface 14 with a first end 16, a second end 18 opposite the first end 16, and a longitudinal axis A. The device 10 also comprises a securing member 20 connected to the substantially planar surface 14 proximate to the first end 16. An elongated holder 22 is connected to the substantially planar surface 14 proximate the second end 18 and substantially perpendicular to the longitudinal axis A. The elongated holder 22 comprises a plurality of raised portions 24 positioned along the elongated holder 22 and extending outward from the substantially planar surface 14 in close proximity to one another. The kit 100 further comprises a plurality of strings 110 having a first end for temporary engagement with the securing member 20 and a second end moveable between adjacent raised portions 24 of the elongated holder 22, as shown in FIG. 2.

The embodiments of the kit 100 disclosed herein can further comprise a storage compartment 60 as described above. The storage compartment 60 having at least one inner cavity and releasably engaged with the base can removably store the plurality of strings 110.

The other embodiments of the device 10 discussed above can all be incorporated into the kit 100 as desired or required.

The kit 100 can include as much or as little string as desired or required. The plurality of strings 110 can be one or more colors, one or more texture, and one or more material. For example, some of the plurality of strings 110 may be blue, red, orange, yellow, etc. In addition, individual string can be multicolored. The plurality of strings 110 can be embroidery string, yarn, thread, rope, etc. The plurality of strings 110 can be silk, cotton, rayon, etc.

Embodiments of the device disclosed herein can be made from plastic. Elements of the device, such as the base, securing member, rail member and elongated holder, can be molded individually and assembled or more than one element of the device can be molded together to reduce the number of parts for assembly. Embodiments of the device disclosed herein can be made out of metal, foam, resin, or any other suitable material providing the strength and rigidity necessary to function as desired or required.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for making knotted string accessories from a plurality of individual strings comprising:

a substantially planar member with a first end and a second end opposite the first end;

a securing member carried by the substantially planar member proximate to the first end and configured to secure a first end of the plurality of individual strings; and an elongated holder carried by the substantially planar member proximate the second end, the elongated holder comprising a plurality of individual raised portions, adjacent raised portions configured to retain at least one of the plurality of individual strings between them at a location a spaced distance from the first end, wherein the securing member is movable relative to the substantially planar member to selectively change a distance between the securing member and the elongated holder.

2. The device of claim 1, wherein the securing member is movably carried by the substantially planar member and positionable at a plurality of discrete locations defined along the substantially planar member, each of the plurality of discrete locations a different distance from the elongated holder.

3. The device of claim 2, wherein the securing member comprises a clip and a spring configured to bias the clip to secure the first end of the plurality of individual strings.

4. The device of claim 2, wherein the securing member is movable along a track in the substantially planar member, the track comprising indentations configured for engagement with the securing member, one indentation positioned at each of the plurality of discrete locations.

5. The device of claim 4, wherein the track is a rail member carried by the substantially planar member having a longitudinal axis extending between the first end and second end, wherein the securing member is movably attached to the rail member.

6. The device of claim 1 further comprising a storage compartment having at least one inner cavity and releasably engaging the substantially planar member.

7. The device of claim 6, wherein the substantially planar member is pivotally attached to the storage compartment and is movable between an open position and a closed position.

8. The device of claim 6, wherein the substantially planar member is slidably attached to the storage compartment and is moveable between an open position and a closed position.

9. The device of claim 6 further comprising a latching mechanism configured to secure the substantially planar member to the storage compartment in a closed position.

10. The device of claim 1, wherein between each of the adjacent raised portions is a slit configured to retain the individual string.

11. The device of claim 1 further comprising indicia, each indicia representing one of the plurality of individual holders.

12. A device for making knotted string accessories from a plurality of individual strings comprising:

a substantially planar surface with a first end and a second end opposite the first end;

a securing member carried by the substantially planar surface proximate to the first end and configured to secure a first end of each of the plurality of individual strings; and an elongated holder carried by the substantially planar surface proximate the second end, the elongated holder comprising a plurality of individual raised portions, adjacent raised portions configured to retain at least one of the plurality of individual strings at a location a spaced distance from the first end, wherein the elongated holder has a longitudinal axis and the elongated holder is non-linear relative to the longitudinal axis.

13. The device of claim 12, wherein the plurality of individual raised portions are spaced equidistant along the elongated holder.

14. The device of claim 12, further comprising a rail member extending between the securing member and the elongated holder.

15. The device of claim 12, wherein a distance between the securing member and the elongated holder is changeable.

16. The device of claim 15, wherein the securing member is movably carried by the substantially planar surface and the distance is changeable by movement of the securing member.

17. The device of claim 16, wherein the securing member is positionable at a plurality of discrete locations defined along the substantially planar surface.

18. The device of claim 14, wherein the securing member is movable along the rail member.

19. The device of claim 12 further comprising a storage compartment having at least one inner cavity.

20. The device of claim 12, wherein an outermost of the plurality of individual raised portions is a first distance from a center point of the securing member and a central of the plurality of individual raised portions is a second distance from the center point, the first distance being less than the second distance.

* * * * *